US005765426A

United States Patent [19]

Saegusa

[11] Patent Number: 5,765,426

[45] Date of Patent: Jun. 16, 1998

[54] PIPE BENDING APPARATUS

[75] Inventor: Shigeru Saegusa, Sunto-gun, Japan

[73] Assignee: Usui Kokusai Sangyo Kaisha Limited, Japan

[21] Appl. No.: 680,712

[22] Filed: Jul. 11, 1996

[30] Foreign Application Priority Data

Jul. 14, 1995 [JP] Japan ..... 7-201386

[51] Int. Cl.[6] ..... B21D 7/00

[52] U.S. Cl. ..... 72/306; 72/311; 72/388; 72/217

[58] Field of Search ..... 72/306, 311, 323, 72/388, 217, 219

[56] References Cited

U.S. PATENT DOCUMENTS

| | | | |
|---|---|---|---|
| 2,414,926 | 1/1947 | Burke | 72/217 |
| 3,245,433 | 4/1966 | Taylor | 72/311 |
| 4,655,069 | 4/1987 | Remy | 72/306 |
| 4,662,204 | 5/1987 | Saegusa | 72/306 |
| 4,702,097 | 10/1987 | Zahlaus | 72/217 |
| 4,735,075 | 4/1988 | Saegusa | 72/306 |
| 4,805,436 | 2/1989 | Saegusa | 72/306 |
| 4,848,120 | 7/1989 | Schwarze | 72/149 |
| 4,945,747 | 8/1990 | Yogo | 72/306 |
| 5,197,320 | 3/1993 | Saegusa | 72/307 |
| 5,305,223 | 4/1994 | Saegusa | 72/149 |

FOREIGN PATENT DOCUMENTS

| | | | |
|---|---|---|---|
| 207721 | 7/1956 | Australia | 72/306 |
| 2704784 | 11/1994 | France | 72/294 |
| 2928813 | 11/1980 | Germany | 72/217 |
| 3620151 | 2/1987 | Germany | 72/306 |

*Primary Examiner*—Daniel C. Crane

*Attorney, Agent, or Firm*—Anthony J. Casella; Gerald E. Hespos; Ludomir A. Budzyn

[57] ABSTRACT

In a pipe bending apparatus, a chuck unit is movable along a straight pipe for holding it in position between a pair of bending units which are also movable along the pipe. The apparatus can bend even a long metal pipe having a small diameter accurately at a desired angle in any of a variety of directions, while allowing it to be quickly set for any bending job.

10 Claims, 6 Drawing Sheets

PIPE BENDING APPARATUS

BACKGROUND OF THE INVENTION

1. Field of the Invention

This invention relates to a pipe bending apparatus used in an automatic pipe bender for bending a metal pipe having a relatively small inside diameter not exceeding, say, 20 mm which is often used to form a passage for supplying oil, gas, etc. to a motor vehicle, or any of various kinds of machines and apparatus.

2. Description of the Related Art

Known apparatus of the kind to which this invention pertains are disclosed in, for example, Japanese Patent Publications Nos. Hei 2-17249, Hei 2-17250 and Hei 5-13011 covering the applications filed by the assignee of this invention. Publication No. Hei 2-17249 or Hei 2-17250 discloses an apparatus which includes a twisting unit for holding a pipe and rotating it on its longitudinal axis to predetermine the direction in which it is to be bent, and a bending unit installed on one side of the twisting unit, or a pair of bending units installed on both sides, respectively, of the twisting unit, for bending the pipe in the predetermined direction. Publication No. Hei 5-13011 discloses an apparatus which includes a chuck unit installed in a fixed position for holding a pipe, and a pair of bending units installed on both sides, respectively, of the chuck unit and each comprising an articulated robot which is movable along the longitudinal axis of the pipe for bending it as required.

The former apparatus has, however, the drawback that, when a pipe is bent at one point after another, its repeated twisting on its longitudinal axis is likely to cause the deformation of any portion thereof that has already been bent, particularly if it is a long pipe having a small wall thickness. Therefore, the apparatus has only a limited scope of application, and is mainly used for bending only a relatively short pipe having a relatively large diameter and a relatively large wall thickness. Moreover, the twisting unit is stationary, and whenever a pipe is not chucked in its mid-portion, it is necessary to change the point at which it is chucked; the apparatus could otherwise be used to bend only a very short pipe.

The chuck unit in the latter apparatus is intended for chucking a pipe at a point between two half portions thereof which have an approximately equal number of points at which it is to be bent, so that the two bending units may each be able to bend it at one point after another to achieve an efficient job with a saving of time. It is necessary to move a pipe hopper to ensure that each pipe be chucked properly as stated above. The apparatus is complicated in construction. Moreover, it is a time-consuming job to set each pipe properly in the apparatus.

SUMMARY OF THE INVENTION

Under these circumstances, it is an object of this invention to provide a pipe bending apparatus which can bend even a long and thin-walled pipe quickly and accurately without causing any bent portion thereof to be deformed, and without employing any pipe hopper that is movable to change the point at which the pipe is chucked.

This object is essentially attained by an apparatus which comprises a chuck unit for holding a straight pipe, and a pair of bending units installed on the opposite sides, respectively, of the chuck unit from each other movably along the longitudinal axis of the pipe, wherein the chuck unit is movable along the longitudinal axis of the pipe.

The chuck unit may be movable by a motor. It may alternatively be possible to make the chuck unit movable by holding it between the two bending units, or by connecting it to one of them. In either event, no special motor is required for moving the chuck unit, but the chuck unit is held in position by e.g. a cylinder after its movement.

If a straight pipe is supplied from a pipe hopper to the two bending units each having a supporting member and a twisting plate, the chuck unit is moved along the pipe to hold it at an appropriate point. Then, the bending units are moved to their remotest positions from the chuck unit and the twisting plate on each bending unit is rotated to predetermine the direction in which the pipe is to be bent. A bending roller unit attached to each twisting plate is driven to bend the pipe in the predetermined direction at an angle to its longitudinal axis. Then, the bending units are moved back to the second remotest positions from the chuck unit and the bending operation as described above is carried out. The movement of the bending units toward the chuck unit is repeated as required to bend the pipe at one point after another toward its mid-portion on either side of the chuck unit. Thus, there is no deformation of any earlier bent pipe portion when the pipe is bent at any point closer to the chuck unit. Therefore, the apparatus can be used to bend even a long pipe having a small diameter and a small wall thickness.

As the chuck unit is movable, no movable pipe hopper is required. The pipe to be bent can quickly be set in the apparatus, and the apparatus is simple in construction.

The twisting plates are rotatable by 360 degrees, and enable the apparatus to bend a pipe in a greatly widened range of shapes with a high level of dimensional accuracy.

DETAILED DESCRIPTION OF PREFERRED EMBODIMENTS

Figure 1:
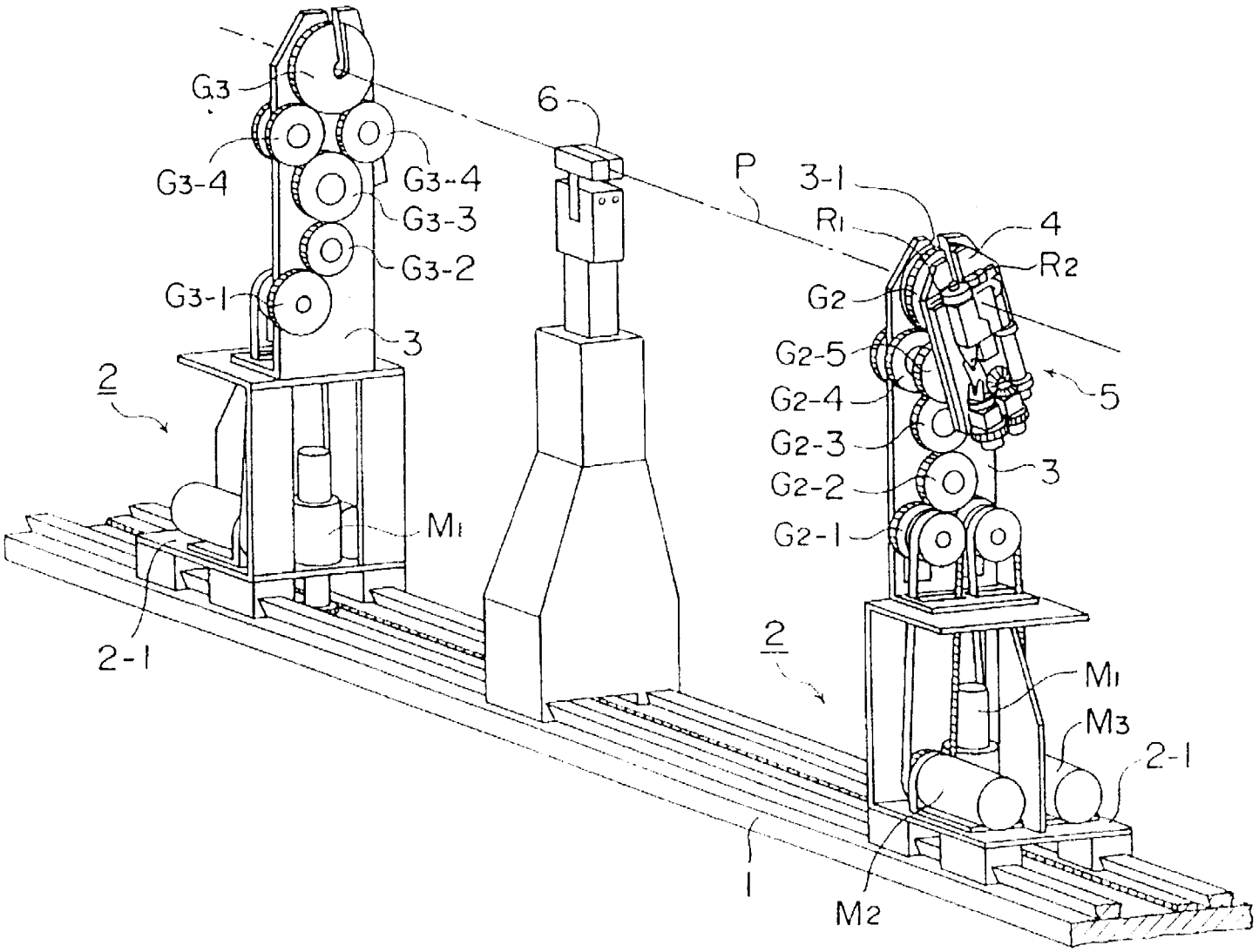
FIG. 1 is a schematic perspective view of a bending apparatus embodying this invention.

A pipe bending unit embodying this invention is shown in FIG. 1 and includes a pair of bending units 2 mounted on a platform 1 movably to and away from each other along the longitudinal axis of a pipe P. Each bending unit 2 is movable by a rack and pinion mechanism connected to a drive motor $M_1$ mounted on a carriage 2-1. Each bending unit 2 has an upwardly extending supporting plate 3 having a pipe engaging slot 3-1 at its upper end to which a bending gear $G_2$, a twisting gear $G_3$ and a twisting plate 4 are attached.

Each bending unit 2 further includes a twisting mechanism which comprises a twisting motor $M_3$ mounted on the carriage 2-1, a gear $G_3$-1 supported on one side of the supporting plate 3 rotatably by a pulley and belt device connected to the motor $M_3$, and the twisting gear $G_3$ to which the rotation of the gear $G_3$-1 is transmitted by a gear $G_3$-2, a gear $G_3$-3 and a pair of gears $G_3$-4.

Figure 5:
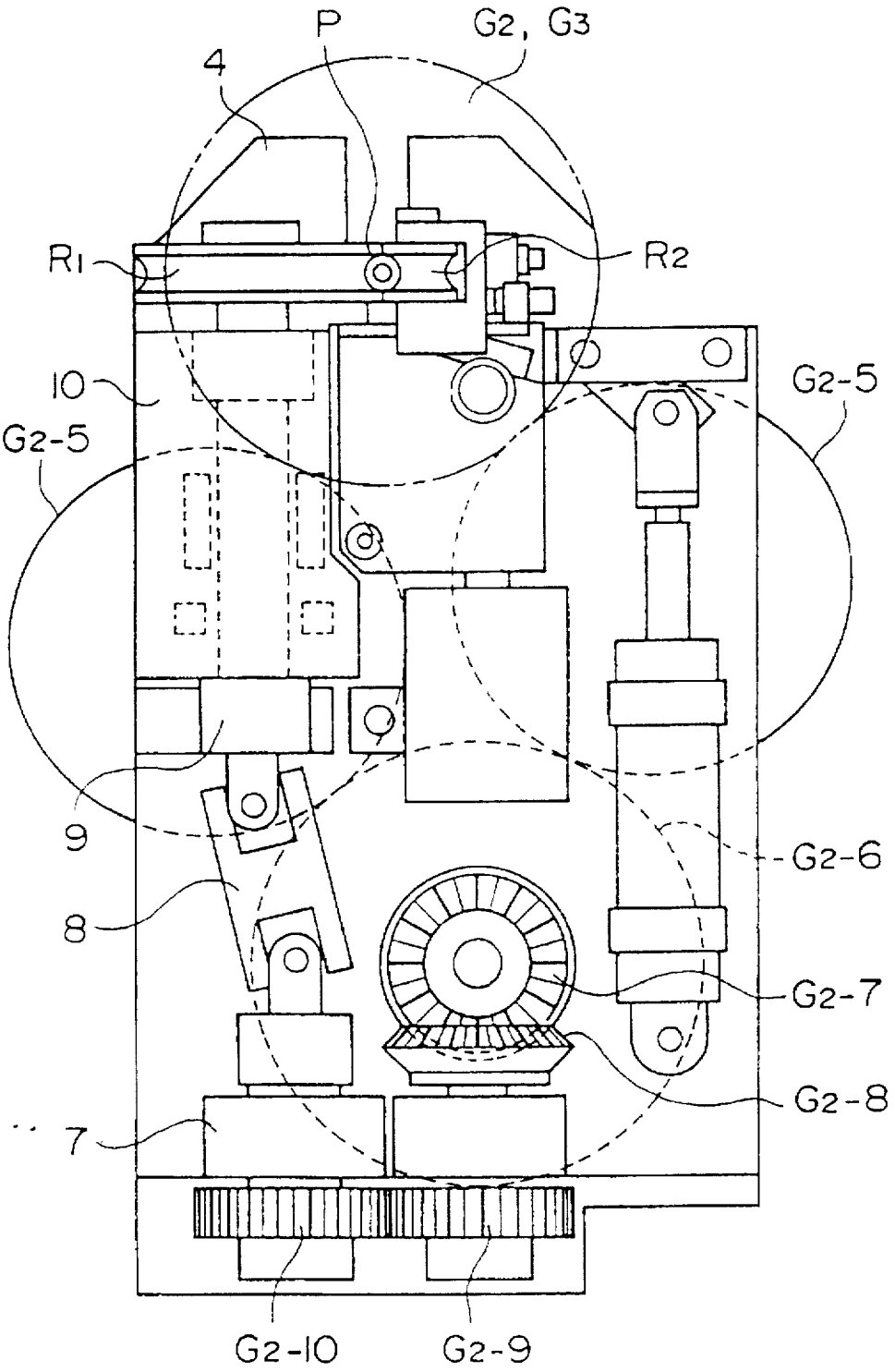
FIG. 5 is a front elevational view of one form of bending unit.
Figure 6:
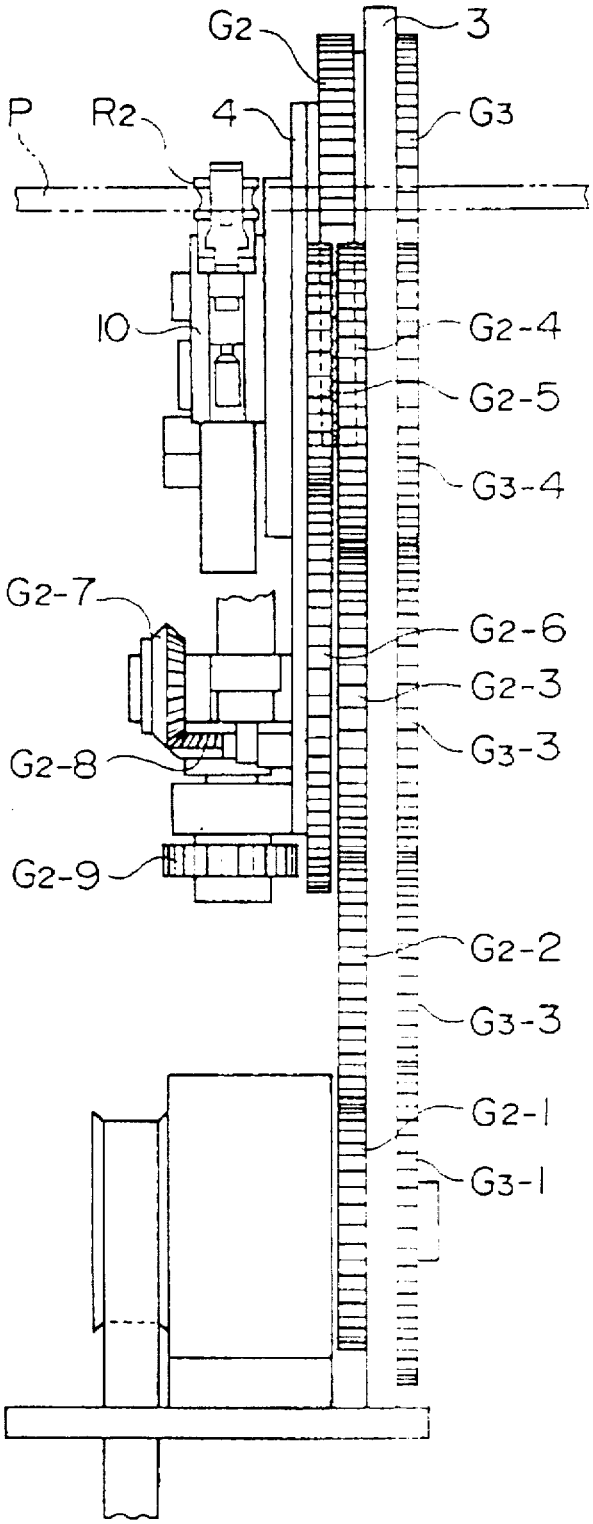
FIG. 6 is a side elevational view of the bending unit shown in FIG. 5.

The twisting plate 4 is connected by a shaft to the twisting gear $G_3$ coaxially with the bending gear $G_2$ as shown in FIGS. 5 and 6. Each of the bending gear $G_2$, twisting gear $G_3$ and twisting plate 4 has a slot aligned with the pipe engaging slot 3-1, so that the pipe P engaged in the pipe engaging slot 3-1 may be held in position by the gears $G_2$ and $G_3$ and the plate 4.

A bending roller unit 5 is mounted on the twisting plate 4 and comprises a stationary die roll $R_1$ and a bending roller $R_2$ which is rotatable about the die roll. The die roll $R_1$ and the bending roller $R_2$ are adapted to define therebetween a cavity in which the pipe can be held.

Each bending unit 2 further includes a bending and twisting mechanism which comprises a bending and twisting motor $M_2$ mounted on the carriage 2-1, a gear $G_2$-1 supported on the other side of the supporting plate 3 rotatably by a pulley and belt device connected to the motor $M_2$, and the bending gear $G_2$ to which the rotation of the gear $G_2$-1 is transmitted by a gear $G_2$-2, a gear $G_2$-3 and a pair of gears $G_2$-4 which are coaxial with the gears $G_3$-2, $G_3$-3 and $G_3$-4, respectively, in the twisting mechanism. The twisting plate 4 carries on one side thereof facing the supporting plate 3 a pair of transmission gears $G_2$-5 meshing with the bending gear $G_2$ and a transmission gear $G_2$-6 meshing with the gears $G_2$-5. The twisting plate 4 carries on the other side thereof a bevel gear $G_2$-7 supported on the same shaft with the gear $G_2$-6, another bevel gear $G_2$-8 meshing with the bevel gear $G_2$-7, a transmission gear $G_2$-9 supported on the same shaft with the bevel gear $G_2$-8 and another transmission gear $G_2$-10 meshing with the gear $G_2$-9, as shown in FIG. 5. A rotor 7 is supported on the same shaft with the gear $G_2$-10, and is connected to a supporting shaft 9 by a connecting member 8. The bending roller $R_2$ is mounted on a holder 10 secured to the supporting shaft 9. The bending roller $R_2$ is movable into and away from circumferential contact with the die roll $R_1$ by a cylinder, or like mechanism.

Figure 2:
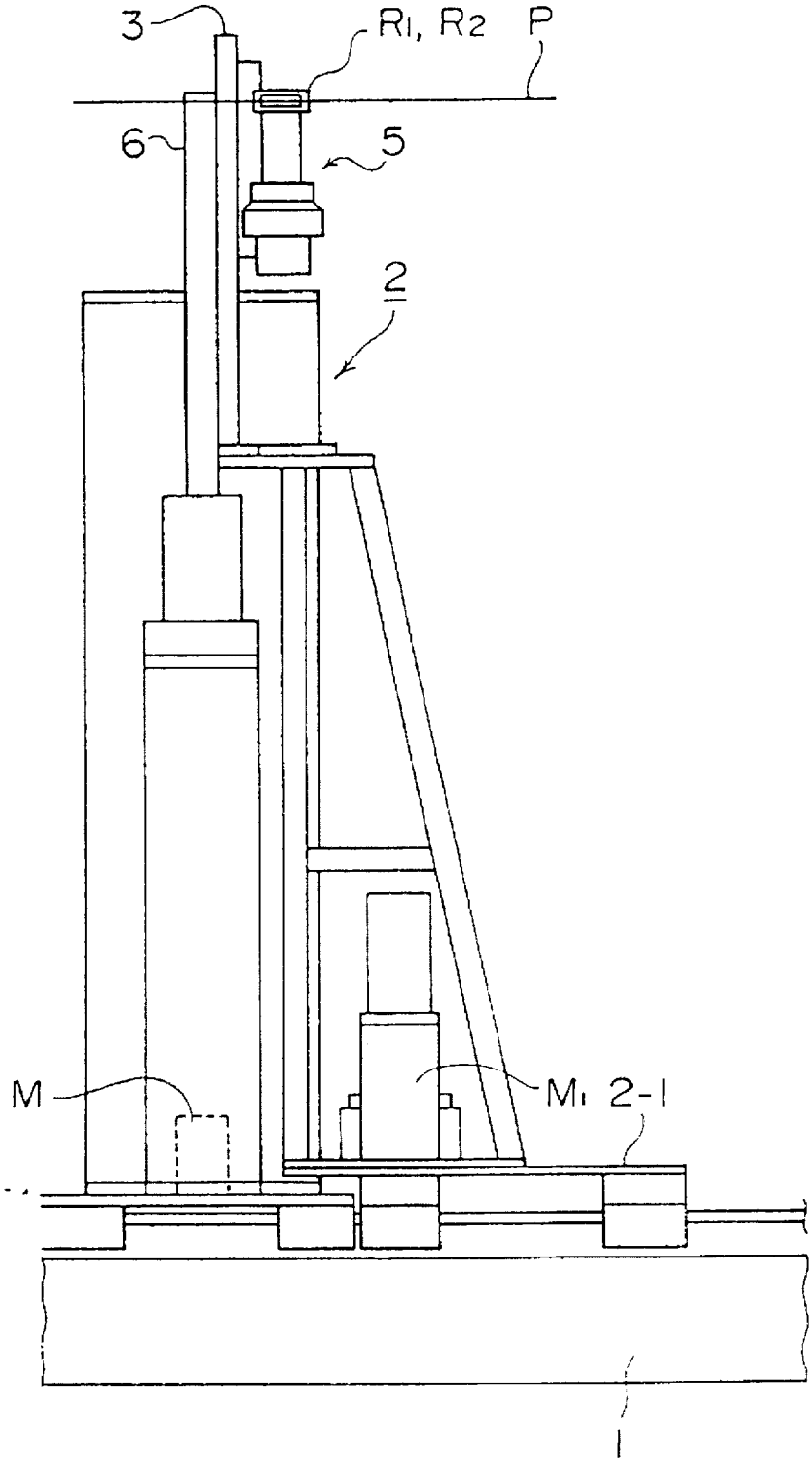
FIG. 2 is a side elevational view showing one form of chuck unit.

The apparatus also includes a chuck unit 6 mounted on the platform 1 between the two bending units 2. The chuck unit 6 is movable along the pipe P by a servo motor M (FIG. 2) to hold the pipe P or release it.

In operation, the pipe P to be bent is supplied from a stationary pipe hopper not shown to the apparatus in which the bending roller $R_2$ in each bending unit 2 stays away from the die roll $R_1$, and away from one end portion of the pipe P which is to be bent. The chuck unit 6 is moved along the pipe P by the servo motor M to hold it at a middle or approximately middle point among the points at which the pipe P is to be bent, for example, at the 8th point if the pipe P has to be bent at 16 points, or at the 11th point if it has to be bent at 23 points. The pipe P is passed at each end through the pipe engaging slot 3-1 of the supporting plate 3 and the slots of the bending gear $G_2$, twisting gear $G_3$ and twisting plate 4 in one of the bending units 2. Each bending unit 2 is so moved that the die roll $R_1$ and the bending roller $R_2$ may be able to hold the pipe P therebetween at a first point at which it is to be bent, and which is closer to one end of the pipe than any other point is, and the bending roller $R_2$ is moved toward the die roll $R_1$ to hold the pipe P against it.

The bending and twisting motor $M_2$ and the twisting motor $M_3$ are driven to rotate the gears $G_2$-1 and $G_3$-1, respectively, so that a train of transmission gears $G_2$-2, $G_2$-3 and $G_2$-4 and a train of transmission gears $G_3$-2, $G_3$-3 and $G_3$-4 may transmit rotation to the bending gear $G_2$ and the twisting gear $G_3$, respectively. The rotation of the gears $G_2$ and $G_3$ causes the twisting plate 4 to rotate about the pipe P at a predetermined angle specifying the direction in which it is to be bent between the die roll $R_1$ and the bending roller $R_2$.

Then, the bending and twisting motor $M_2$ alone is driven to rotate the bending gear $G_2$ and the transmission gears $G_2$-5 and $G_2$-6 on the back of the twisting plate 4, while the twisting motor $M_3$ and the gears $G_3$-1, $G_3$-2, $G_3$-3, $G_3$-4 and $G_3$ are kept out of rotation. The rotation of the gear $G_2$-6 causes the bevel gear $G_2$-7 on the opposite side of the twisting plate 4 to rotate, and its rotation is transmitted to the supporting shaft 9 through the bevel gear $G_2$-8, transmission gears $G_2$-9 and $G_2$-10, rotor 7 and connecting member 8. The rotation of the supporting shaft 9 causes the holder 10 to rotate to thereby rotate the bending roller $R_2$ by a predetermined angle about the die roll $R_1$, whereby the pipe P is bent at the first point.

Then, the bending and twisting motor $M_2$ is rotated in the opposite direction to move back the bending roller $R_2$ to its initial position, and the motor $M_1$ for driving the bending unit 2 is started to move it along the pipe P toward the chuck unit 6, so that the bending unit 2 may be ready for bending the pipe P at a second point. The sequence of operation as described above is repeated for bending the pipe P at the second point, and at any other point thereafter until it is bent at all of the predetermined points by each bending unit 2, whereafter the chuck unit 6 is actuated to release the pipe P.

Figure 3:
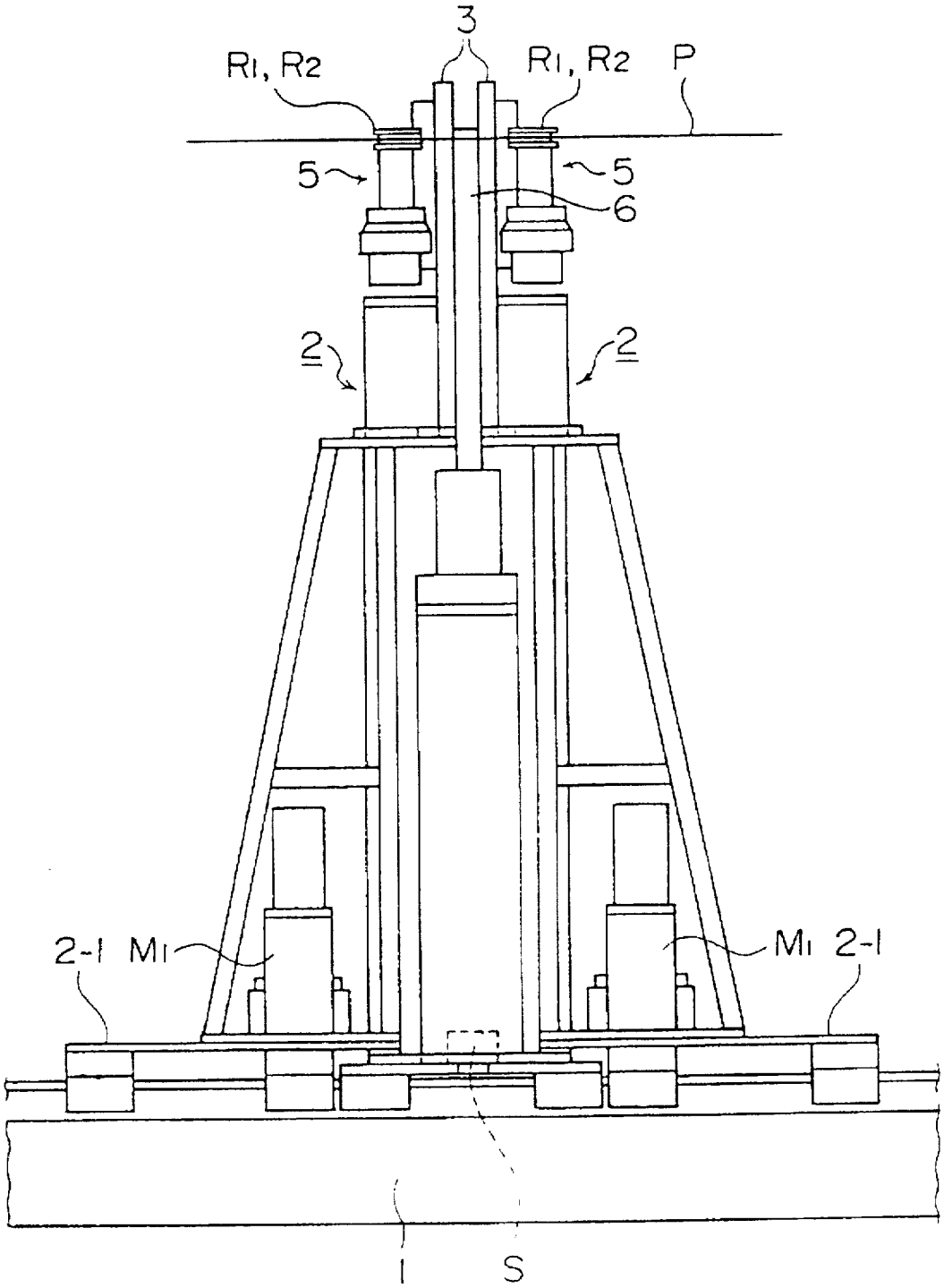
FIG. 3 is a side elevational view showing another form of chuck unit.

Reference is now made to FIG. 3 showing a different form of apparatus embodying this invention and featured by a different form of chuck unit 6. The chuck unit 6 shown in FIG. 3 does not have any servo motor as shown at M in FIG. 2, but has a cylinder S in its place. The chuck unit 6 is movable along a platform 1 when held between two bending units 2, as shown in FIG. 3. It is moved by the bending units 2 when either of the latter is moved by a motor $M_1$ on a carriage 2-1, and the chuck unit 6 which has been moved to an appropriate position is secured to the platform 1 by the action of the cylinder S. The apparatus is identical in any other aspect of construction and operation to the apparatus shown in FIGS. 1, 2, 5 and 6.

Figure 4:
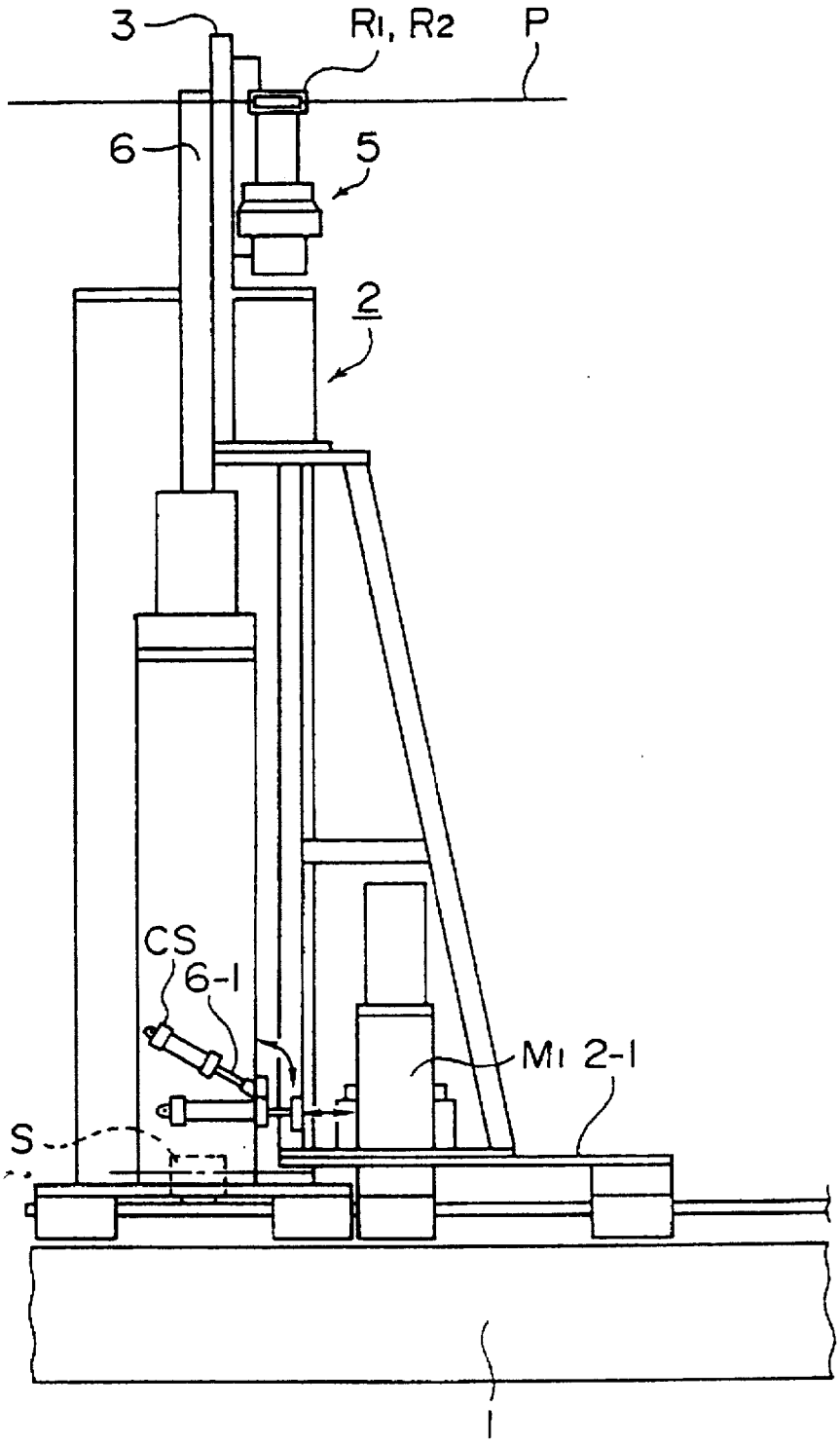
FIG. 4 is a side elevational view showing still another form of chuck unit.

A still different form of apparatus is shown in FIG. 4 and is also featured by a different form of chuck unit 6. The chuck unit 6 shown in FIG. 4 does not have any servo motor as shown at M in FIG. 2, either, but has a cylinder S in its place. The apparatus also includes a connecting cylinder CS which can be engaged with a portion 6-1 of the chuck unit 6 facing one of two bending units 2 to connect the chuck unit 6 to the bending unit 2. The chuck unit 6 is movable along a platform 1 when connected to the bending unit 2 by the cylinder CS, and when the bending unit 2 is moved by a motor $M_1$. The chuck unit 6 which has been moved to an appropriate position is secured to the platform 1 by the action of the cylinder S. The apparatus is identical in any other aspect of construction and operation to the apparatus shown in FIGS. 1, 2, 5 and 6.

Although a mechanism including bevel gears has been shown and described for transmitting rotation to the supporting shaft 9 (FIG. 9), it may be replaced by a rack and pinion mechanism. The apparatus of this invention can be employed for performing a totally automatic pipe bending operation if data covering the bending points on a pipe and the twisting and bending angles at each point are stored in an automatic control unit not shown.

What is claimed is:

1. A pipe bending apparatus comprising a chuck unit for holding an initially straight pipe in a selected position, portions of said pipe being held by said chuck defining a longitudinal axis, said chuck unit being movable in directions parallel to the longitudinal axis, a pair of bending units between which said chuck unit is mounted, and which are movable along the longitudinal axis of the pipe, wherein each of said bending units comprises an upstanding supporting plate for supporting the pipe at its upper end; a twisting plate supported on said supporting plate rotatably by an angle of 360 degrees about said axis of the pipe to specify a bending angle; a bending roller unit attached to said twisting plate for bending the pipe at said bending angle in a plane perpendicular to said twisting plate; a twisting motor mounted on a carriage on which said bending unit is mounted; a bending and twisting motor mounted on said carriage; a first means carried on one side of said supporting plate for transmitting the rotation of said twisting motor to said twisting plate; and a second means carried on the other side of said supporting plate for transmitting the rotation of said bending and twisting motor to said bending roller unit.

2. An apparatus as set forth in claim 1, wherein said second means comprises a mechanism including bevel gears.

3. An apparatus as set forth in claim 1, wherein said second means comprises a mechanism including a rack and a pinion.

4. An apparatus as set forth in claim 1, wherein said chuck unit is movable by a servo motor mounted on a platform on which said chuck and bending units are mounted.

5. A pipe bending apparatus for placing a plurality of bends in a pipe, said pipe having opposed first and second ends and an initially straight portion between said ends, said initially straight portion of said pipe defining a longitudinal axis, said apparatus comprising: a chuck unit for securely holding said pipe at a selected location along said straight portion of said pipe intermediate said first and second ends, and first and second bending units disposed respectively between said chuck unit and said first and second ends of said pipe, each said bending unit being movable along the longitudinal axis of the pipe, said chuck unit being movable in a direction parallel to said longitudinal axis of said pipe when held by and between said bending units, each said bending unit including twisting means for rotating the bending unit about the longitudinal axis into a position corresponding to a predetermined direction of bend, each said bending unit further comprising bending means for bending the pipe a predetermined amount in the predetermined direction established by the twisting means, whereby movement of the chuck unit enables secure non-rotatable gripping of the pipe at an optimum location for the plurality of bends to be placed by the bending units.

6. An apparatus as set forth in claim 5, wherein said chuck unit is provided with a cylinder for securing it in position.

7. A pipe bending apparatus for placing a plurality of bends in a pipe, said pipe having opposed first and second ends and an initially straight portion between said ends, said initially straight portion of said pipe defining a longitudinal axis, said apparatus comprising: a chuck unit for securely holding said pipe at a selected location along said straight portion of said pipe intermediate said first and second ends, and first and second bending units disposed respectively between said chuck unit and said first and second ends of said pipe, each said bending unit being movable along the longitudinal axis of the pipe, said chuck unit being movable in a direction parallel to said longitudinal axis of said pipe when connected to one of said bending units, each said bending unit including twisting means for rotating the bending unit about the longitudinal axis into a position corresponding to a predetermined direction of bend, each said bending unit further comprising bending means for bending the pipe a predetermined amount in the predetermined direction established by the twisting means, whereby movement of the chuck unit enables secure non-rotatable gripping of the pipe at an optimum location for the plurality of bends to be placed by the bending units.

8. An apparatus as set forth in claim 7, wherein said one bending unit is provided with a cylinder for connecting said chuck unit to said one bending unit.

9. An apparatus as set forth in claim 8, wherein said chuck unit is provided with a cylinder for securing it in position.

10. An apparatus as set forth in claim 7, wherein said chuck unit is provided with a cylinder for securing it in position.

* * * * *